US011834921B2

(12) United States Patent
Schauerte

(10) Patent No.: US 11,834,921 B2
(45) Date of Patent: Dec. 5, 2023

(54) ARRANGEMENT OF A GROUND DRILLING DEVICE, METHOD FOR OPERATING A GROUND DRILLING DEVICE AND USE OF AN ARRANGEMENT OF A GROUND DRILLING DEVICE

(71) Applicant: TRACTO-TECHNIK GmbH & Co. KG, Lennestadt (DE)

(72) Inventor: Manfred Schauerte, Schmallenberg (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 6 days.

(21) Appl. No.: 17/582,517

(22) Filed: Jan. 24, 2022

(65) Prior Publication Data

US 2022/0243533 A1 Aug. 4, 2022

(30) Foreign Application Priority Data

Feb. 2, 2021 (DE) ..... 10 2021 000 497.3

(51) Int. Cl.
*E21B 3/025* (2006.01)
*E21B 7/04* (2006.01)
*E21B 7/00* (2006.01)

(52) U.S. Cl.
CPC ..... *E21B 3/025* (2013.01); *E21B 7/005* (2013.01); *E21B 7/046* (2013.01)

(58) Field of Classification Search
CPC ..... E21B 3/025; E21B 7/005
See application file for complete search history.

(56) References Cited

U.S. PATENT DOCUMENTS

| | | | | |
|---|---|---|---|---|
| 853,010 | A * | 5/1907 | Gray | E21B 7/005 175/162 |
| 885,041 | A * | 4/1908 | Guthrie | E21B 7/005 173/184 |
| 2,643,858 | A | 6/1953 | Hardman | |
| 2,693,345 | A | 11/1954 | Martin et al. | |
| 2008/0217070 | A1 | 9/2008 | Barbera | |

FOREIGN PATENT DOCUMENTS

| | | |
|---|---|---|
| DE | 19608980 C2 | 5/1998 |
| EP | 0 715 057 A1 | 6/1996 |

* cited by examiner

*Primary Examiner* — Jonathan Malikasim
(74) *Attorney, Agent, or Firm* — Leason Ellis LLP

(57) ABSTRACT

Arrangement of a ground drilling device for the pushing or pulling introduction of a drill string into the ground, wherein the arrangement has a frame and a carriage which can be moved back and forth relative to the frame with a translatory movement, wherein at least one rolling element is provided, which is configured to roll during the translatory movement of the carriage, and a conversion device is provided, which is connected to the rolling element and is configured to convert the rotary movement of the rolling element into a rotary movement of the drill string.

10 Claims, 2 Drawing Sheets

ARRANGEMENT OF A GROUND DRILLING DEVICE, METHOD FOR OPERATING A GROUND DRILLING DEVICE AND USE OF AN ARRANGEMENT OF A GROUND DRILLING DEVICE

The invention relates to an arrangement of a ground drilling device for the pushing or pulling introduction of a drill string into the ground, to a method for operating a ground drilling device, and to a use of an arrangement of a ground drilling device for the pushing or pulling introduction of a drill string into the ground.

It is known to use an arrangement of a ground drilling device for the pushing or pulling introduction of a drill string into the ground, in which, for example, a push-pull drive engages via coupling means into projections or recesses of a drill string with a tool at the end. For example, DE 196 08 980 C2 describes a ground drilling device that consists of a mount with a hydraulic piston-cylinder unit that linearly moves a carriage back and forth. The carriage is connected to a pawl which, when the carriage is advanced, engages behind a rung of a ladder rod which is part of a drill string and thus advances the ladder rod having the drill head in accordance with the stroke of the hydraulic piston-cylinder unit in the drilling direction. At the end of the stroke, the pawl automatically disengages from the rung and the carriage returns to the original position thereof.

Although a rotary drive for the drill string allows a higher propulsive power and/or allows it to work in more difficult ground conditions, the combination of a rotary drive with the translatory movement of the carriage is difficult to coordinate. The integration of the rotary drive for the drill string and the translatory drive for the carriage can also require greater effort. Furthermore, the provision of a rotary drive for the drill string has hitherto been associated with having to resort to a high drive power. In addition, a rotary drive for the drill string has hitherto entailed higher production costs, since, for example, an additional drive motor or drive cylinder has to be provided. As a rule, a ground drilling device having a rotary drive for the drill string has a significantly higher weight than a ground drilling device without a rotary drive. In the past, this caused a rotary drive to be dispensed with, in particular in the case of smaller ground drilling devices, although the resulting propulsive power was lower due to the lack of rotation of the drill string.

It is the object of the invention to create an arrangement for a ground drilling device with which a higher propulsive power is possible, by means of which at least one disadvantage known from the prior art is overcome in particular.

The object is achieved by the subject matter of the independent claims. Advantageous embodiments are the subject matter of the corresponding dependent claims and/or emerge from the following description.

The core idea of the present invention is to use the back-and-forth movement of the carriage in order to obtain a rotary movement of the drill string from the translatory movement of the carriage. It can be provided that the back-and-forth movement of the carriage, which is provided in any case for the pushing or pulling drive of the drill string, is converted, wherein the conversion of the translatory movement of the carriage takes place in addition to the pushing or pulling movement of the drill string, in order to rotate the drill string. The translatory movement of the carriage can first be converted into a rotary movement by means of a rolling element, which rolling element rolls during the translatory movement. A conversion device which may be present and is connected to the rolling element can convert the rotary movement of the rolling element into a rotary movement of the drill string. A part of the feed energy of the ground drilling device can thus be used to generate a rotary movement. No additional drive, for example in the form of a drive motor or drive cylinder, is required for rotating the drill string. The feed cylinder that is required or is provided in any case for the translatory movement of the carriage can also be used for the rotation of the drill string. Simple and inexpensive components are required for the implementation of the core idea of the invention, of which the rolling element can be configured as an element on an axle. The conversion device that can be provided can convert the rotation of the rolling element into a rotary movement of the drill string, wherein, in particular, a step-up and/or step-down can be set. The embodiment according to the core idea of the invention can result in additional weight which is only slightly increased. There is added value for the user, who can obtain a simple arrangement with a high propulsive power, which arrangement can be arranged in particular in a (duct) manhole or a construction pit having small dimensions.

The invention creates an arrangement of a ground drilling device for the pushing or pulling introduction of a drill string into the ground. The arrangement has a frame and a carriage which can be moved back and forth relative to the frame with a translatory movement. At least one rolling element is provided, which rolling element is configured to roll during the translatory movement of the carriage, it being possible for the rotary movement of the rolling element to be converted into a rotary movement of the drill string. For example, the rolling element can be directly and functionally coupled to a receptacle, so that the rolling of the rolling element causes a rotation of the receptacle.

The term "arrangement" is used in the description to describe the region of the ground drilling device that primarily or initially causes the pushing or pulling introduction of the drill string into the ground. The term "arrangement" in the context of the description is to be understood as a type of drive for the drill string, in which the carriage is moved back and forth, and an engagement element provided on the carriage is connected to the drill string in a direction in order to impart the corresponding movement on the drill string.

The term "ground drilling device" in the context of the description comprises any device that can move a drill string having rod sections in an existing channel or in a channel to be created in the ground, in order to create or widen a bore, in particular a horizontal bore, or to drive pipes or other elongate bodies into the ground. A ground drilling device can comprise an arrangement for the pushing or pulling introduction of a drill string into the ground. The ground drilling device can in particular be arranged in a construction pit or a manhole, in particular a duct manhole.

The term "horizontal drilling" in the context of the description comprises in particular any type of, preferably horizontal, channels existing or to be created in a body, in particular underground channels including boreholes, rock bores, or underground lines as well as underground or above-ground pipelines and water channels that can be created or dug in using a corresponding ground drilling device.

The term "ground" in the context of the description comprises any solid material, in particular sand, rock, earth, fixed or loose stones, or the like.

The term "drill string" in the context of the description comprises a string having a drill head and a rod, which drill string can be moved by means of a ground drilling device or an arrangement of the ground drilling device for the introduction of a borehole through the ground.

The term "rod" in the context of the description comprises not only exclusively rigid rods that have individual rod sections that are directly or indirectly connected to one another and that can be used in a ground drilling device. In a preferred embodiment, the rod sections are configured to be rigid. To connect the rod sections to one another and to form the drill string, a plug connection of the individual drill string links is preferably provided. A non-rotatable connection of the rod sections or drill string links may be preferable.

The term "rod sections" in the context of the description comprises an element which extends along a longitudinal axis, which element is part of the rod or drill string for borehole drilling or for the pushing or pulling introduction. The rod section can be designed as an element which is arranged at the front side in the drill string and has an associated function (transmitter housing or the like) or as an element that merely physically lengthens the drill string as a rod section. The rod section can comprise one or more mechanical channels, such as for drilling fluid, one or more electrical conduits, one or more electrical elements, and/or one or more electronic elements.

The rod sections can be connected to one another by means of end-side mechanical coupling or connecting elements, it being possible, for example, for a "male connector" to be provided on one of the rod sections and a "female connector" to be provided on the other of the rod sections. The terms "male connector" and "female connector" in the context of the description are an embodiment of a pair of connecting elements, one of which ("male connector") can be inserted at least partially into the other ("female connector") in order to at least partially establish the connection of the two rod sections to one another. It can be provided that the rod sections are, in particular non-rotatably, connected simply by plugging them in; further elements, which can protrude through one or both rod sections, for example, in order to secure the connection in particular, can be provided.

The ground drilling device described can be provided by means of the carriage moving back and forth to pull the drill string out of the ground or push the drill string into the ground in one of the two directions of movement, in particular in one working stroke preferably by the length of a rod section. In a direction of movement of the carriage (idle stroke), which movement is opposite to the movement of the drill string in the ground, a drive element which has been detached from the drill string can result in a further rod section being able to be added or a rod section being able to be removed. In a further stroke in the direction of movement of the drill string (working stroke), the drill string can be reduced by one rod section (pulling drive) or lengthened by one rod section (pushing drive). The movement of the carriage in the frame can substantially be matched to the length of a rod section. A stroke can substantially correspond to a length of a rod section.

In a preferred embodiment, a rod section in the context of the description can have an outer diameter of 25 mm to 65 mm, preferably 30 mm to 60 mm, preferably 35 mm to 55 mm, preferably 40 mm to 50 mm. In a preferred embodiment, a rod section in the context of the description can have an overall length of 450 mm to 650 mm, preferably 500 mm to 600 mm, preferably 520 mm to 580 mm. In a preferred embodiment, a rod section in the context of the description can have a useful length which, in particular, takes into account the length of the female connector and the male connector. The useful length can result from the total length reduced by the length of the connecting element or elements and can be 400 mm to 600 mm, preferably 450 mm to 550 mm, preferably 475 mm to 525 mm.

In a preferred embodiment, a rod section in the context of the description can have a groove for engaging an engagement element of the arrangement for moving the drill string in a pulling or pushing direction along the longitudinal axis, for example a (locking) pawl, which can have an outer diameter of 15 mm to 55 mm, preferably 20 mm to 50 mm, preferably 25 mm to 45 mm, preferably 30 mm to 40 mm.

In a particularly preferred embodiment, the total length of the rod section can be 550 mm and the outer diameter of the rod section can be 45 mm. In a particularly preferred embodiment, the outer diameter of a rod section can be 45 mm. In a particularly preferred embodiment, the outer diameter can have a groove for engaging an engagement element of the arrangement, such as the (locking) pawl, for moving the drill string in a pushing or pulling direction along the longitudinal axis of the rod section having an outer diameter of 35 mm.

The stated values for the outer diameter of the rod section, the (total) length of the rod section, the useful length of the rod section, and the outside diameter of a groove on the rod section are not restrictive values; in particular, the size of the construction pit or the manhole for the arrangement of the ground drilling device and/or the nature of the ground can be adapted in order to carry out a borehole efficiently.

The term "frame" in the context of the description comprises a structural element of a ground drilling device to provide a guide for a relative back-and-forth movement of the carriage. By means of the frame, the ground drilling device can be supported in a standing position in a construction pit, a manhole, or on the ground. The frame can define a guide or a track for the back-and-forth movement of the carriage. In a preferred embodiment, the frame can have a substantially rectangular base area. As a rule, the base area can have a larger dimension in one direction of expansion than in the other direction. As a rule, the direction of expansion having the larger dimension corresponds to a direction which is substantially parallel to the drilling direction of the borehole. The longitudinal extent (longitudinal direction) can correspond to the direction of extent having the larger dimension. The frame can have a length in the longitudinal extent that is preferably 550 mm to 1,050 mm, more preferably 600 mm to 1,000 mm, more preferably 650 mm to 950 mm, more preferably 700 mm to 900 mm, more preferably 750 mm to 900 mm, more preferably 800 mm to 900 mm. The frame can have a length transverse to the longitudinal extent that is preferably 350 mm to 600 mm, more preferably 350 mm to 550 mm, more preferably 350 mm to 500 mm, more preferably 400 mm to 500 mm, more preferably 450 mm to 500 mm. The stated dimensions can relate to the base area of the frame, one or more guide tubes for supporting the frame in the construction pit or the manhole being able to be provided on the frame, in particular in the longitudinal direction. A support element can be extended from a guide tube and brought into contact with the construction pit or the manhole.

The term "carriage" as used in the context of the description comprises an element of the ground drilling device which has an engagement element for engaging the drill string and which can be moved back and forth relative to the frame. In particular, the engagement element can be configured in such a way that it is possible to automate the introduction of the drill string. In the desired effective direction (pushing or pulling), the engagement element can be brought into engagement with the drill string, while the engagement element automatically disengages from the drill string during the movement of the carriage in the "idle stroke" (against the effective direction). For example, the engagement element can be configured as a (locking) pawl known from the prior art. The engagement element preferably engages with the drill string by means of a groove designed on the drill string or a rod section.

In a preferred embodiment, at least one hydraulic cylinder is provided which is connected to the carriage and the frame. The at least one hydraulic cylinder can be connected to the carriage and the frame by means of a form fit, a material fit, or any other type, which can also be a combination of the types of connection. In a particularly preferred embodiment, the at least one hydraulic cylinder can be connected in a form-fitting manner to the carriage and/or the frame in the two different directions in which the hydraulic cylinder can act by inserting or introducing the hydraulic cylinder into receptacles on the carriage and/or the frame. The orientation of the at least one hydraulic cylinder can be substantially parallel to the longitudinal direction (longitudinal extent) of the frame.

The movement of the carriage relative to the frame can be caused or brought about by means of at least one hydraulic cylinder, in particular several or two hydraulic cylinders. Due to the force that is exerted on the drill string in order to push or pull it into the ground, the at least one hydraulic cylinder or the two or more hydraulic cylinders with regard to their longitudinal axis can be aligned can by means of the at least one hydraulic cylinder, in particular two or more hydraulic cylinders, such that the longitudinal axis/axes of the at least one hydraulic cylinder or of the plurality of hydraulic cylinders is/are arranged substantially offset parallel to the longitudinal axis of the drill string in the region of the carriage. The at least one hydraulic cylinder or the several hydraulic cylinders can make it possible to use a force that effectively acts on the drill string, wherein the drive by means of one or more hydraulic cylinders provides a very good starting position in terms of providing a large force for the ground drilling device. The combination of the drive for the pulling or pushing force exerted on the drill string by means of a hydraulic cylinder or hydraulic cylinders and a rotation of the rolling element, through which the rotation of the drill string or the drill head of the drill string is initiated, allows an advantageous use of a type of a drive and of an implementation that does justice both to the pulling or pushing action on the drill string and to the action of torque on the drill string. The conversion of a purely translatory movement of the carriage, which movement was caused by a translatory movement of the hydraulic cylinder or a plurality of hydraulic cylinders, into a rotary movement for the drill string was not considered possible in the embodiment of the invention. One or more hydraulic cylinders can be used to drive the translatory movement of the carriage.

A "rolling element" in the context of the description comprises an element that can have a body that rolls about an axis of rotation. The term "rolling" is to be interpreted broadly and relates to rolling or shuffling around an axis of rotation in general or around a counter-element that may be present. The body can form a portion of the rolling element. The rolling element can have the axis of rotation, about which the rolling body rolls, as a shaft on which the body can be arranged and, in particular, fixedly connected thereto. The rolling body of the rolling element is preferably designed to be rotationally symmetrical about the axis of rotation (which can be designed as a shaft) of the rolling element. Insofar as a shaft is described, this is understood to mean a component which can bring about a mechanical coupling with a conversion device which may be present. For example, the shaft can be configured as a stub shaft, or the conversion device is connected directly to the rolling element. A rotationally symmetrical embodiment of the rolling body of the rolling element can allow uniform movement and transmission. During the translatory back-and-forth movement of the carriage, the rolling element can be forced to roll and thus perform a rotary movement. It can be provided that the axis of rotation of the rolling element moves in a translatory manner, in particular in one plane. The axis of rotation can be moved with the carriage, in which case the axis of rotation can in particular be displaced parallel to the direction of movement of the carriage.

It can also be provided that the "rolling element" is an element that rolls around or inside a counter-element. For example, the rolling element can be configured as an element having a thread; for example, the rolling element can be designed as an element having an external or internal thread which rolls on a counter-element with a corresponding thread that engages with the thread of the rolling element. In one embodiment, it can be provided that the rolling element is configured as a body with an internal thread/external thread which can roll on a counter-element with a corresponding external thread/internal thread. In the embodiment in which the rolling element has a thread, it can be provided that a shaft on the rolling element can be dispensed with. The rolling element can roll by means of the thread when the carriage is moved, in that a rolling movement is carried out around a counter-element that is present in particular.

If it is described that the translatory movement of the carriage can result in a forced rotation of the rolling element, this is to be understood as meaning that the movement of the carriage can result in a rolling of the rolling element. In particular, however, the option is also included that the rolling element can be prevented from rolling during the back-and-forth movement of the carriage, for example to allow the drill string not to be rotated over a period of time or length portion desired by the user. If the user wishes to rotate the drill string, the rolling element can be forced to roll during the back-and-forth movement of the carriage without the user having to take any further action. The user has the option, as it were, of switching the forced movement of the rolling element, i.e. the rolling of the rolling element, on and off during the back-and-forth movement of the carriage. The rotary movement of the drill string can be "switched off," for example, by preventing the rolling element from rolling or by making it "freewheel" relative to the axis of rotation so that the rolling element can continue to rotate but is no longer non-rotatable relative to the shaft.

The preferred embodiment that the carriage is moved in a translatory manner relative to the frame by means of at least one hydraulic cylinder, in particular several hydraulic cylinders, preferably two hydraulic cylinders, creates the simplified option of "disengaging" the rolling element in order to end the rotary loading of the drill string. Precisely the combination of a causally translatory force that does not arise from a rotary movement or is not converted from this can result in a simple decoupling of translatory movement and a rotary movement of the rolling element that initiates and is to be converted into the rotary movement of the drill string.

The term "conversion device" in the context of the description comprises a device that can be provided and is mechanically connected to the rolling element or coupled in terms of movement, which device is configured to convert the rotary movement of the rolling element into a rotary movement of the drill string, so that in particular the alignment of the axis can be changed, about which axis the rotary movement of the rolling element takes place. In addition to a drive element and/or a driven element, the conversion device can have a deflection element which is optionally present in order to deflect the rotation of the rolling element about the axis of rotation into the axis of rotation of the rotary movement of the drill string between the drive element and the driven element.

The conversion device can be understood as a gear with which the rotary movement of the rolling element is converted into a rotary movement of the drill string, wherein the conversion can take place with regard to the corresponding axes of rotation in order to effectively use a rotation about the longitudinal axis of the drill string from the rotation of the rolling element. A step-up and/or step-down can be set by means of the conversion device.

The conversion device can have an element that moves with the rolling element, which element can be in particular non-rotatably connected to the rolling element. An element (drive element) of this type can be realized in that the element (drive element) is connected to the shaft to which the rolling element can be connected. In particular, the conversion device can have an element (drive element) which can be directly or indirectly engaged or directly or indirectly is engaged with the drill string and which can impart the rotary movement to the drill string.

If it is described in the description that the rotary movement of the drill string can be prevented or suppressed or switched off, this can also be done in the region of the conversion device, for example by means of a mechanical separation of the drive element from the rolling element, a mechanical separation of the drive element from the driven element, and/or a mechanical separation of the driven element from the element which can be directly engaged with the drill string in order to impart a rotary movement to the drill string.

The rotary movement can be imparted to the drill string by means of a "receptacle." The receptacle can be engaged with the conversion device. The receptacle can be designed in such a way that the receptacle surrounds the drill string or a rod section of the drill string at least partially on the circumferential side, and/or an element is formed on the receptacle, which element is non-rotatably connected in an engaged manner to the drill string or a rod section of the drill string in order to impart the rotary movement. The receptacle can in particular have an element facing the drill string, which element can be designed at least partially as a male connector or a female connector of the rod assembly. By means of the connecting element on the receptacle or a receptacle configured as a connecting element, the receptacle can be connected to the drill string in a shear-resistant, pull-resistant, and non-rotatable manner. The receptacle can be connected to the carriage in a shear-resistant and pull-resistant manner. The receptacle can be rotatably arranged on the carriage. In order to transmit the rotary movement, the receptacle can be functionally connected to the rolling element. In particular, the optionally present conversion device, which in turn can be connected to the rolling element, can be non-rotatably connected to the receptacle.

With the invention, it is possible to pursue the approach, which at first seems counterintuitive, of using a rolling movement for the rotary movement of the drill string, the axis of rotation of which can run transversely to the longitudinal axis of the drill string. Although the axis of rotation of a rolling element is not initially in a direction substantially parallel to the longitudinal axis of the drill string about which it is to be rotated, this simple imparting of a rolling movement can be used for a rotary movement of the drill string. No complicated conversion or loading is necessary, and the rolling element can be rolled along the path, in particular along the entire path on which the carriage moves in a translatory manner. In particular, the movement of the rolling element can be a linear rolling movement, which movement can have a high efficiency with regard to the conversion of movement from translatory movement into rotary movement or rotation of the rolling element. The simple approach can be used for using a linearly guided rolling element, which does not have to perform any complicated movement, as the drive for the rotary movement of the drill string. The rolling element can be mounted with a shaft on the carriage in an end-side region (front or rear) or in particular in a central region.

According to a preferred embodiment, a counter-element is provided which is in contact with the rolling element and on which the rolling element rolls. Defined conditions for the rolling of the rolling element can be created by means of the counter-element. The rolling of the rolling element can be improved. In particular, the efficiency of the rolling or the rotation of the rolling element can be increased. In a particularly preferred embodiment, the counter-element is configured in such a way that the rolling element can roll linearly on the counter-element. The rolling of the rolling element on the counter-element can take place substantially linearly, without curves, in particular helical lines, having to be completed by the rolling element.

According to a preferred embodiment, the rolling element is mounted on the carriage, and the counter-element is arranged in a stationary manner outside of the carriage. In a preferred embodiment, the counter-element can be arranged in a stationary manner on the frame, as a result of which handling can be improved. Defined conditions can be created which can be independent of the placement or setup of the arrangement or the ground drilling device, since the counter-element can be arranged on the ground drilling device itself.

In a preferred embodiment, the rolling element is a wheel, and/or the counter-element is an element that is in a frictional fit or a force fit and/or a partial form fit connection with the rolling element. In a particularly preferred embodiment, the counter-element is a linear drive element, i.e. a drive element which is linearly aligned. In particular, the rolling element can be a chain wheel, a gear wheel, or any other wheel. The linear drive element can in particular be a linear drive element meshing with the correspondingly designed wheel. For example, the counter-element can be configured as a link chain, a toothed rack, or the like. It is also possible for the rolling element to be a rolling element having an internal and/or external thread, which rolls on a stationary counter-element or on a counter-element arranged on the frame, which counter-element can have a corresponding counter-thread. The thread can in particular be configured as a steep, non-self-locking thread. In the case of an embodiment of this type of a rolling element, it is possible to convert the linear movement of the carriage directly into a rotary movement of the rolling element. In the latter case, the rolling element can be configured, for example, as an element carried along by the carriage or arranged thereon, in particular in the form of a nut. The rolling element in the form of a nut can rotate or roll on a fixedly mounted threaded rod, which means that a conversion device can be dispensed with.

According to a preferred embodiment, the rolling element has an axis of rotation which runs transversely to the translatory movement of the carriage. As a result, defined conditions for the rolling and imparting of the movement can be created, with the term "defined" in the context of the description being understood in such a way that the term "transverse" not only comprises a right-angled arrangement of the two directions mentioned, but also deviations thereof, which can in particular be production-related. In the case of a rolling element with an axis of rotation which runs transversely to the translatory movement of the carriage or the carriage track, a rotational speed can be selected for the rolling element, which rotational speed is primarily independent of the stroke but primarily dependent on the rolling element.

The term "transverse" in the context of the description can comprise an arrangement in which the named elements form an angle with the respective axes, which angle is greater than 0 degrees. The term "transverse" to one another is preferably to be understood as an angle of greater than 45 degrees to one another, preferably the angle can be greater than 50 degrees, more preferably greater than 60 degrees, more preferably greater than 70 degrees, more preferably greater than 80 degrees, in particular 90 degrees.

The rolling element can also have an axis of rotation which runs along the translatory movement of the carriage. In this way, defined conditions can be created for the rolling and the imparting of the movement, wherein in particular a conversion device can be dispensed with. As a result, the number of elements involved in imparting the rotary movement on the drill string can be kept small. In particular, the rolling element can be displaced or moved along the axis of rotation if the axis of rotation runs along the translatory movement of the carriage. For example, a rolling element having an internal and/or external thread can roll on a counter-element which has a corresponding thread. The counter-element can be stationary or at rest, for example fixedly mounted.

The term "longitudinal" in the context of the description can comprise an arrangement in which the directions mentioned enclose an angle between 0 degrees and 50 degrees, preferably 0 degrees to 40 degrees, preferably 0 degrees to 30 degrees, more preferably 0 degrees to 20 degrees, more preferably 0 degrees to 10 degrees. In a particularly preferred embodiment, the angle is in the range of +/−5 degrees, +/−4 degrees, +/−3 degrees, +1-2 degrees, +1-1 degree. Due to the arrangement, the rotary movement can be transmitted directly to the receptacle, wherein an interposition of a gear stage can be provided, if necessary, thereby causing an increase in the rotational speed.

In a preferred embodiment, the conversion device has a drive element which is at least indirectly engaged, in particular directly engaged, with the rolling element, and a driven element which is at least indirectly or directly engaged with the drill string. In this way, a torque transmission can be created, which converts the rolling movement of the rolling element into a rotary movement of the drill string. A small number of elements can be preferable in order to keep the weight of the arrangement low. Furthermore, a small number of elements can result in low manufacturing costs.

In a preferred embodiment, the drive element is a toothed belt pulley or a bevel gear and/or the driven element is a toothed belt pulley or a bevel gear. The toothed belt pulley and the bevel gear allow efficient transmission of the rotary movement by means of a corresponding division, and the rotary movement imparted on the drill string can be influenced by means of the division. If necessary, the conversion device can contain a deflection element which can be a toothed belt, for example in the case of toothed belt pulleys, which can be guided between the two toothed belt pulleys via a deflection roller. A desired increase and/or reduction ratio or a step-up and/or step-down can be selected or set by means of one or more toothed belts, toothed belt pulleys, bevel gears, and the like.

The invention also provides a ground drilling device having an arrangement as described in the description. The ground drilling device can be any ground drilling device, with the advantages of the invention being more important for small ground drilling devices that have a small base area of the frame and/or a small diameter of the rod sections than for large ground drilling devices. In this respect, the arrangement for ground drilling devices with the described dimensions of the frame can be integrated into the arrangement in these ground drilling devices, or the ground drilling device can be designed with this arrangement, in order to create the option of a rotary movement of the drill string even for inexpensive ground drilling devices, in order to allow a high propulsive power with regard to the dimensions of smaller ground drilling devices and/or to be able to work in more difficult ground conditions. The arrangement creates added value for the user, in particular for these ground drilling devices provided with smaller dimensions.

The invention also provides a method for operating a ground drilling device, in which method a carriage of the ground drilling device is moved back and forth relative to a frame with a translatory movement in order to drive a drill string in the pushing or pulling working direction into the ground, wherein a rolling element rolls during the translatory movement, and the rotary movement of the rolling element is converted into a rotary movement of the drill string.

The invention also provides a use of an arrangement of a ground drilling device for the pushing or pulling introduction of a drill string into the ground, wherein the arrangement has a frame and a carriage which can be moved back and forth relative to the frame with a translatory movement, wherein at least one rolling element is used, which rolls during the translatory movement, and the rolling movement is used to impart a rotary movement to the drill string by means of the rotary movement of the rolling element.

Numerical information in the context of the description is information that may have a tolerance of +/−10%, in particular +/−5%, so that the numerical information not only describes one value, but a range of values, in particular to take account of tolerance ranges that may be production-related.

The invention has been described in relation to three aspects relating to the arrangement, the method, and the use. The description of the individual aspects with features, including the embodiment of the ground drilling device with the arrangement, complement each other in terms of their description, so that in particular embodiments on the aspect of the arrangement, i.e. in particular features of a device, also apply for the description of the other aspects by means of features of a method or use. If a feature is described with regard to one aspect, in particular the arrangement, then this description is also to be understood as a description for a feature of the method or use and also of the ground drilling device.

Like the following description of embodiments, the above statements do not constitute a waiver of specific embodiments or features.

The invention is explained in more detail below with reference to an embodiment shown in the drawings, in which.

Figure 1:
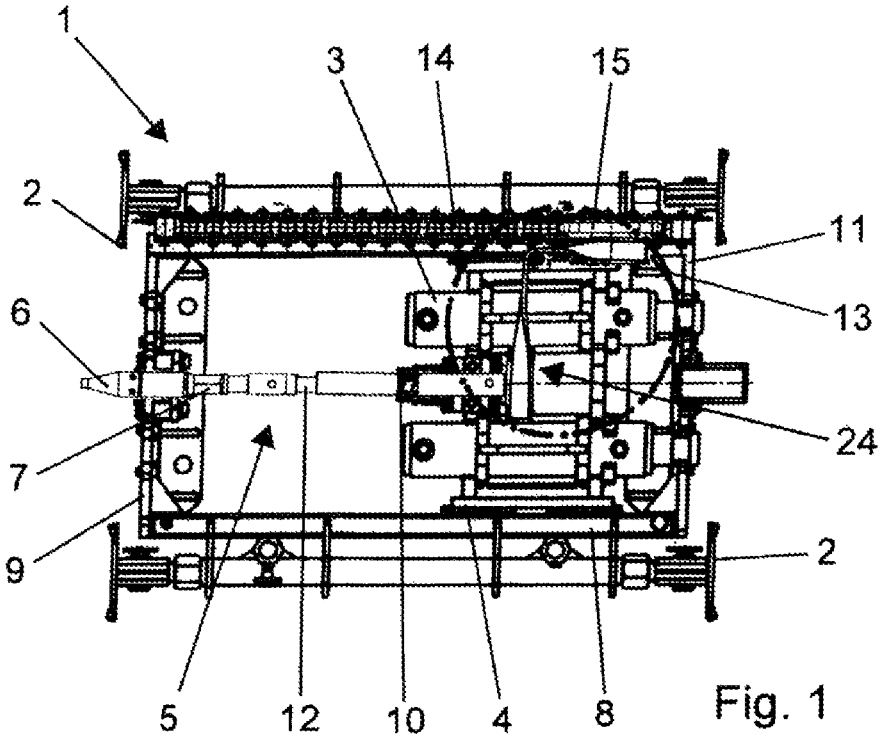
FIG. 1 is a plan view of an arrangement of a ground drilling device and a drill string.

FIG. 1 shows an arrangement of a ground drilling device 1 in a plan view. For anchoring or stabilizing the ground drilling device 1 in a starting excavation or a duct manhole, the ground drilling device 1 has extendable or telescopic support elements 2 which are arranged in the corner regions of a frame 8 of the ground drilling device 1.

A drill string 5 having rod sections can be introduced into the ground by means of the ground drilling device 1. In the embodiment shown, the drill string 5 has a ground drilling tool in the form of a drill head 6 arranged at the front side. A transmitter receptacle 7 is arranged in the drill string 5 behind the drill head 6.

For the pushing or pulling introduction of the drill string 5, two hydraulic cylinders 3 are provided, which hydraulic cylinders move an engagement element 10 back and forth, which engagement element is configured as a pawl and can be connected to the drill string 5. The engagement element 10 is fastened to a carriage 4. The engagement element 10 is fastened to the carriage 4 in such a way that a change in the working direction is possible. For this purpose, the engagement element 10 can be rotated. The carriage 4 can move relative to the frame 8 by means of an operation of the hydraulic cylinders 3. This allows a translatory movement of the carriage 4 relative to the frame 8 in a back-and-forth movement. In the illustrated embodiment, a fixed point for a detachable attachment of the hydraulic cylinder 3 is provided on a front frame plate 9 and on a rear frame plate 11.

To move the drill string 5, the engagement element 10 pushes itself out of a groove 12 of a rod section of the drill string 5 during a retraction (idle stroke) and falls into another groove 12 of a rod section when it reaches it, so that the hydraulic cylinders 3 can advance the drill string 5 further in one working stroke. For a pulling working direction (not shown) of the hydraulic cylinders 3, such as may be required for pulling in lines, the hydraulic cylinders 3 are rotated transversely to their longitudinal direction. It is possible that the cylinder or piston side of the hydraulic cylinder 3 with the greater force is available for the working stroke and the piston rod side can be used for a quick return stroke, i.e. the idle stroke.

Figure 2:
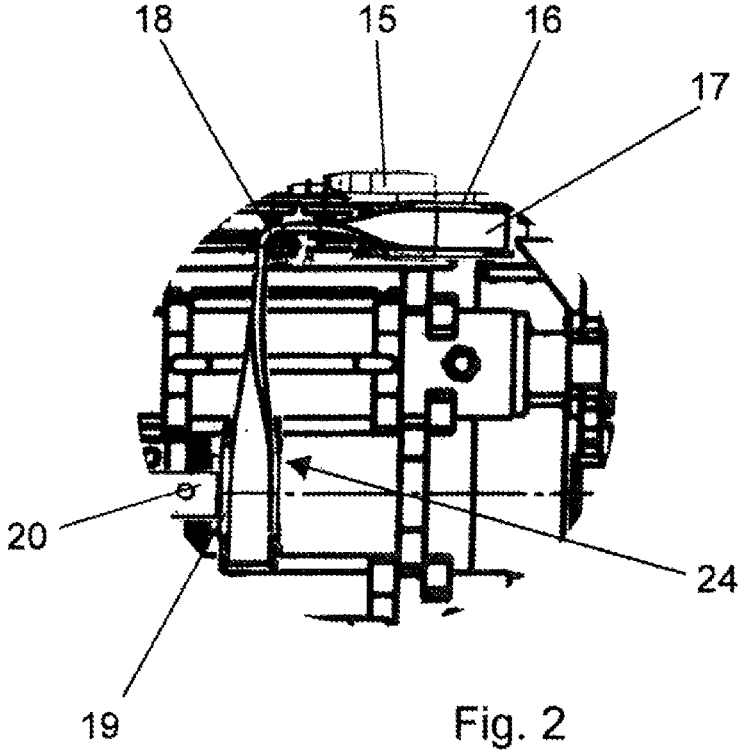
FIG. 2 is an enlarged representation of FIG. 1 of the region marked in FIG. 1 with a dot-dash circle.

The region marked with a dot-dash circle 13 in FIG. 1 is shown enlarged in FIG. 2.

In order to generate a rotary movement of the drill string 5, the arrangement of the ground drilling device 1 has a rolling element 15 which is configured as a chain wheel in the embodiment of FIG. 1. The rolling element 15 is mounted on the carriage 4 with a shaft which is non-rotatably connected to the rolling element 15 and rolls during the translatory movement of the carriage 4. The rolling takes place on a counter-element 14 configured as a roller chain. The rolling element 15 engages in the counter-element 14. The rolling element 15 is rotated by means of the back-and-forth movement of the carriage 4.

A conversion device 24 is provided, which conversion device has a toothed belt pulley 16 (drive element) which is non-rotatably connected to the rolling element 15 and which drives a toothed belt 17. The toothed belt 17 is rotated by means of a deflection roller 18 on the one hand in the longitudinal direction thereof by 90 degrees and on the other hand is continued in an angled manner by 90 degrees, where it drives another toothed belt pulley 19 (driven element). The toothed belt pulley 19 is non-rotatably connected to a receptacle 20 for the drill string 5. The receptacle 20, which is coupled to the toothed belt pulley 19, rotates the drill string 5 when it is acted upon by the conversion device 24.

By means of the rolling element 15 and the conversion device 24 which has the driven element (toothed belt pulley 19) and the drive element (toothed belt pulleys 16), a translatory movement of the carriage 4 triggered by the hydraulic cylinder 3 can be converted into a rotary movement of the drill string 5. The drill string 5 having the drill head 6 at the front end thereof can be rotated during the pushing or pulling introduction.

By means of the rotary movement of the drill string 5, directional drilling can be achieved in such a way that the drill head 6 is brought into a specific radial position (clock time) associated with the desired change in direction. This can arise, for example, in that the carriage 4 is brought into a position in which the drill head assumes the desired radial position in terms of its time. A clutch can separate the non-rotatable connection between the driven toothed belt pulley 19 (driven element) and the receptacle 20 (engagement element for the rotary movement), so that the drill head 6 no longer rotates during further advance in order to carry out the change of direction, i.e. the drill string 5 remains in the steering direction.

In a further embodiment (not shown), the engagement of the rolling element 15 with the counter-element 14 can be separated, for example by the rolling element 15 being moved or pivoted out of engagement with the counter-element 14. It can also be provided that the engagement of the rolling element 15 with the counter-element 14 can be achieved by lowering or raising or pivoting the counter-element 14 away. After the end of the change in direction of the drilling process, the original state can be restored, so that the drill string 5 with the drill head 6 rotates again during the linear movement of the carriage 4.

Figure 3:
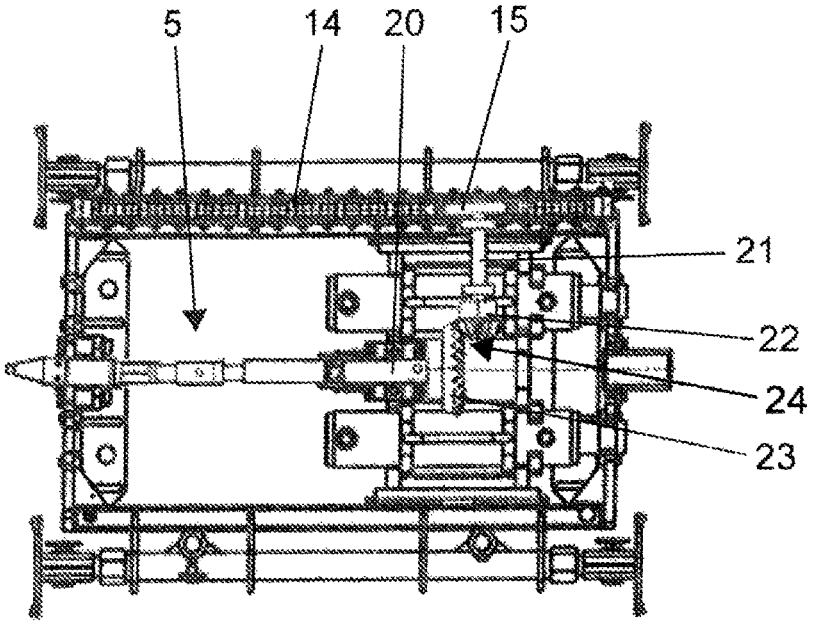
FIG. 3 is a further embodiment of an arrangement of a ground drilling device with a drill string in plan view.

FIG. 3 shows an alternative embodiment of an arrangement of a ground drilling device 1 with the ground drilling device 1 and a drill string 5 in a plan view. The same elements are provided with the same reference signs, and substantially the toothed belt drive of the conversion device 24 from FIG. 1 has been replaced by a bevel gear drive. The counter-element 14 is designed as a roller chain and, during the linear movement of the carriage 4, causes the rotation of the rolling element 15 which is configured as a chain wheel. The rolling element 15 configured as a chain wheel is non-rotatably connected via a shaft 21 to a bevel gear 22 designed as a pinion of a conversion device 24 designed as a bevel gear and drives the bevel gear 23 of the conversion device 24, which in turn is non-rotatably connected to the receptacle 20 for the drill string 5, and thus drives the drill string 5 having the drill head 6. The rotary movement is interrupted in a manner analogous to that already described for the embodiment in FIGS. 1 and 2, by means of a clutch on the conversion device 24 or, alternatively, by physical separation of the rolling element 15 and counter-element 14.

The invention claimed is:

1. A ground drilling device (1) comprising a frame (8) and a carriage (4) which can be moved back and forth relative to the frame (8) with a translatory movement, wherein at least one rolling element (15) mounted on the carriage (4) and a counter-element (14) arranged in a stationary manner outside of the carriage (4) are provided, the at least one rolling element configured to roll, with rotary movement when moved translationally together with the carriage (4) and in engagement with the counter-element (14), so that the translational movement of the carriage (4) is converted into the rotary movement of the rolling element (15)

wherein the ground drilling device introduces the drill string (5) into the ground by a pushing or pulling movement, and further comprising a conversion device (24) that is connected to the rolling element (15) and configured to convert the rotary movement of the rolling element (15) into a rotary movement of the drill string (5).

2. The ground drilling device according to claim 1, wherein a counter- element (14) is provided which is in contact with the rolling element (15) and on which the rolling element (15) rolls.

3. The ground drilling device according to claim 2, wherein the rolling element (15) is mounted on the carriage (4), and the counter-element (14) is arranged in a stationary manner outside of the carriage (4).

4. The ground drilling device according to claim 2, wherein the rolling element (15) is a wheel, the counter-element (14) is a linear drive element, or both the rolling element (15) is a wheel and the counter-element (14) is a linear drive element.

5. The ground drilling device according to claim 1, wherein the rolling element (15) has an axis of rotation which runs transversely to the translatory movement of the carriage (4).

6. The ground drilling device according to claim 1, wherein the rolling element (15) is arranged to be moved transversely to the axis of rotation when rolling or to be moved along the axis of rotation when rolling.

7. The ground drilling device according to claim 1, wherein the conversion device (24) has a drive element which is at least indirectly engaged with the rolling element (15) and a driven element which is at least indirectly engaged with the drill string (5).

8. The ground drilling device according to claim 7, wherein the driven element is a toothed belt pulley (16, 19) or a bevel gear (22, 23), the drive element is a toothed belt pulley (16, 19) or a bevel gear (22, 23), or both the driven element is a toothed belt pulley (16, 19) or a bevel gear (22, 23) and the drive element is a toothed belt pulley (16, 19) or a bevel gear (22, 23).

9. A method of operating a ground drilling device (1), comprising moving a carriage (4) of the ground drilling device (1) back and forth relative to a frame (8) with a translatory movement in order to drive a drill string (5) in a pushing or pulling working direction into the ground, wherein a rolling element (15) is mounted on the carriage (4) and a counter-element (14) is arranged in a stationary manner outside of the carriage (4), wherein the rolling element (15) rolls, with rotary movement, when moved translationally together with the carriage (4) and in engagement with the counter-element (14), so that the translational movement of the carriage (4) is converted into the rotary movement of the rolling element (15)

wherein the ground drilling device (1) further comprises a conversion device (24) that is connected to the rolling element (15) and configured to convert the rotary movement of the rolling element (15) into a rotary movement of the drill string (5).

10. A method of using a ground drilling device (1) for the pushing or pulling introduction of a drill string (5) into the ground, wherein the arrangement has a frame (8) and a carriage (4) which can be moved back and forth relative to the frame (8) with a translatory movement, wherein at least one rolling element (15) is mounted on the carriage (4) and a counter-element (14) is arranged in a stationary manner outside of the carriage (4), wherein the at least one rolling element rolls, with rotary movement, when moved translationally together with the carriage (4) and in engagement with the counter-element (14), so that the translational movement of the carriage (4) is converted into the rotary movement of the rolling element (15)

wherein the ground drilling device (1) further comprises a conversion device (24) that is connected to the rolling element (15) and configured to convert the rotary movement of the rolling element (15) into a rotary movement of the drill string (5).

* * * * *